US005689845A

United States Patent [19]

Sobieralski

[11] Patent Number: 5,689,845

[45] Date of Patent: Nov. 25, 1997

[54] EXPANSIBLE AIR CELL CUSHION

[75] Inventor: Richard F. Sobieralski, St. Clair County, Ill.

[73] Assignee: Roho, Inc., Belleville, Ill.

[21] Appl. No.: 633,463

[22] Filed: Apr. 17, 1996

[51] Int. Cl.[6] ..... A47C 27/10

[52] U.S. Cl. ..... 5/654; 5/655.3; 297/452.41

[58] Field of Search ..... 5/710, 654, 655.3, 5/655.5, 644, 706; 297/DIG. 3, 452.41

[56] References Cited

U.S. PATENT DOCUMENTS

| | | | |
|---|---|---|---|
| 1,198,687 | 9/1916 | Williams et al. | 5/706 |
| 1,569,937 | 1/1926 | Turner | 5/706 |
| 2,415,150 | 2/1947 | Stein | 5/710 |
| 2,703,416 | 3/1955 | Owen | 5/706 |
| 3,112,956 | 12/1963 | Schick et al. | 5/654 |
| 3,274,624 | 9/1966 | Noerdinger | 5/710 |
| 3,428,974 | 2/1969 | Stuart | 5/710 |
| 3,605,145 | 9/1971 | Graebe . | |
| 3,870,450 | 3/1975 | Graebe . | |
| 4,459,714 | 7/1984 | Lin | 297/DIG. 3 |
| 4,541,136 | 9/1985 | Graebe . | |
| 4,629,433 | 12/1986 | Magid . | |
| 4,630,863 | 12/1986 | Roberts . | |
| 4,631,765 | 12/1986 | Casey | 5/417 |
| 4,697,290 | 10/1987 | Alklind et al. . | |
| 4,698,864 | 10/1987 | Graebe | 297/DIG. 3 |
| 4,745,648 | 5/1988 | Viesturs . | |
| 4,788,730 | 12/1988 | Bexton . | |
| 4,822,309 | 4/1989 | Vandenberg . | |
| 4,878,258 | 11/1989 | Casey | 5/502 |
| 4,962,553 | 10/1990 | Marquis | 5/710 |
| 4,998,311 | 3/1991 | Ernst | 297/219 |
| 5,052,068 | 10/1991 | Graebe . | |
| 5,133,096 | 7/1992 | Neumann . | |
| 5,153,956 | 10/1992 | Nold | 5/944 |
| 5,163,196 | 11/1992 | Graebe et al. | 5/654 |
| 5,182,825 | 2/1993 | Stinson et al. | 5/625 |
| 5,388,292 | 2/1995 | Stinson et al. . | |
| 5,402,545 | 4/1995 | Jolley | 5/653 |

*Primary Examiner*—Alexander Grosz

*Attorney, Agent, or Firm*—Polster, Lieder, Woodruff & Lucchesi, L.C.

[57] ABSTRACT

An add-on segment to an air filled cushion having inflatable flexible air cells in which the add-on segment has corresponding air cells and is physically and pneumatically connected to those air cells of the base cushion adjacent to the add-on segment air cushions. The base cushion is expandable to allow for growth of the patient using the cushion and is especially adapted for pediatric use.

25 Claims, 4 Drawing Sheets

EXPANSIBLE AIR CELL CUSHION

BACKGROUND OF THE INVENTION

This invention relates generally to cushions, more particularly to expansible air cell cushions, and specifically relates to pediatric wheelchair cushions of the type which have inflatable interconnected upstanding air cells.

In particular, the present invention relates to an air cell cushion which can grow with the user without compromising the adjustment attributes of the cushion. This is accomplished by providing additional rows of cells which are physically attached to and also are pneumatically plugged into the base cushion. This increases the width and/or depth of the cushion, depending on the needs of the particular user.

Wheelchair cushions are expensive because of the care required in fabrication of specially prescribed and fitted cushions and the difficulties of fabrication of such special cushions, as well as the time required for fitting, etc. With a typical pediatric patient, it is not unusual for the patient to outgrow a special cushion in a matter of months, much as a child outgrows clothes and shoes in a short time. The cost of providing fitted cushions for children who will outgrow the system in a short time has become too costly for both third party payers and for family. The body configuration of older persons also can change over the years, e.g., gain in weight, and this cushion has usefulness for such users.

The present invention, which provides a cushion which grows with the patient while still providing the medical effectiveness needed for the patient's situation, meets the economic and functional demands of the market.

Roho, Incorporated manufactures under license from Robert H. Graebe a number of air cell cushions, most of which are suitable as the base cushion of this invention. Such base cushions are described in Graebe U.S. Pat. Nos. 3,870,450; 4,541,136; 4,698,864; 5,052,068; 5,163,196; etc., all of which are incorporated herein by reference.

Essentially, the Graebe cushions are comprised of a base member sealed to an upper member which has integral upstanding inflatable air cells. The air cells are interconnected by passages in the base in various patterns, whereby the pressure on the patient is equalized over the patient's surface area as the patient sinks into and is immersed in the cells. Different sets of cells may be interconnected so as to effect positioning of the patient by inflating or deflating the different sets. Also, there may be sets of cells of different sizes on the cushion to help in positioning of the patient.

The concept of physically interconnecting cushion sections to make a larger cushion or mattress is not new and is disclosed in various forms in patents to Noerdinger U.S. Pat. No. 3,274,624; Casey U.S. Pat. No. 4,631,765; Marquis U.S. Pat. No. 4,962,553; Neumann U.S. Pat. No. 5,133,096; Nold U.S. Pat. No. 5,153,956; and Stinson et al U.S. Pat. No. 5,182,825. Marquis U.S. Pat. No. 4,962,553, in fact, interconnects cushions manufactured by Roho, Incorporated to make a mattress. However, none of the cushions known to me pneumatically interconnects sections to make a cushion which will grow with the size of the patient, while maintaining equalized pressure throughout the base cushion and the add-on section.

Accordingly, it is a principal object of the present invention to provide a cushion, specifically, a wheelchair cushion, which is comprised of inflatable cells and which has the ability to have rows of cells physically and pneumatically attached to the periphery of the cushion to expand the cushion in width and/or depth, i.e. laterally or longitudinally, to accommodate growth in the user of the cushion, without compromising the functional attributes of the cushion in supporting the user. In addition to wheelchair cushions, the cushions of this invention can be used on other seating surfaces, including auto seats.

These and other objects and advantages will become apparent hereinafter.

SUMMARY OF THE INVENTION

The present invention comprises a base cushion formed with inflatable upstanding air cells with add-on rows of cells capable of being both pneumatically and physically connected to the base cushion, whereby the cushion is usable as the user grows in size without compromising the therapeutic effectiveness of the cushion. The cushion is particularly effective for the pediatric patient and is economically effective in avoiding the necessity of purchasing a new cushion with each change in size of a rapidly growing young patient.

DESCRIPTION OF THE DRAWINGS

In the drawings, wherein like numbers refer to like parts wherever they occur.

DETAILED DESCRIPTION

Figure 1:
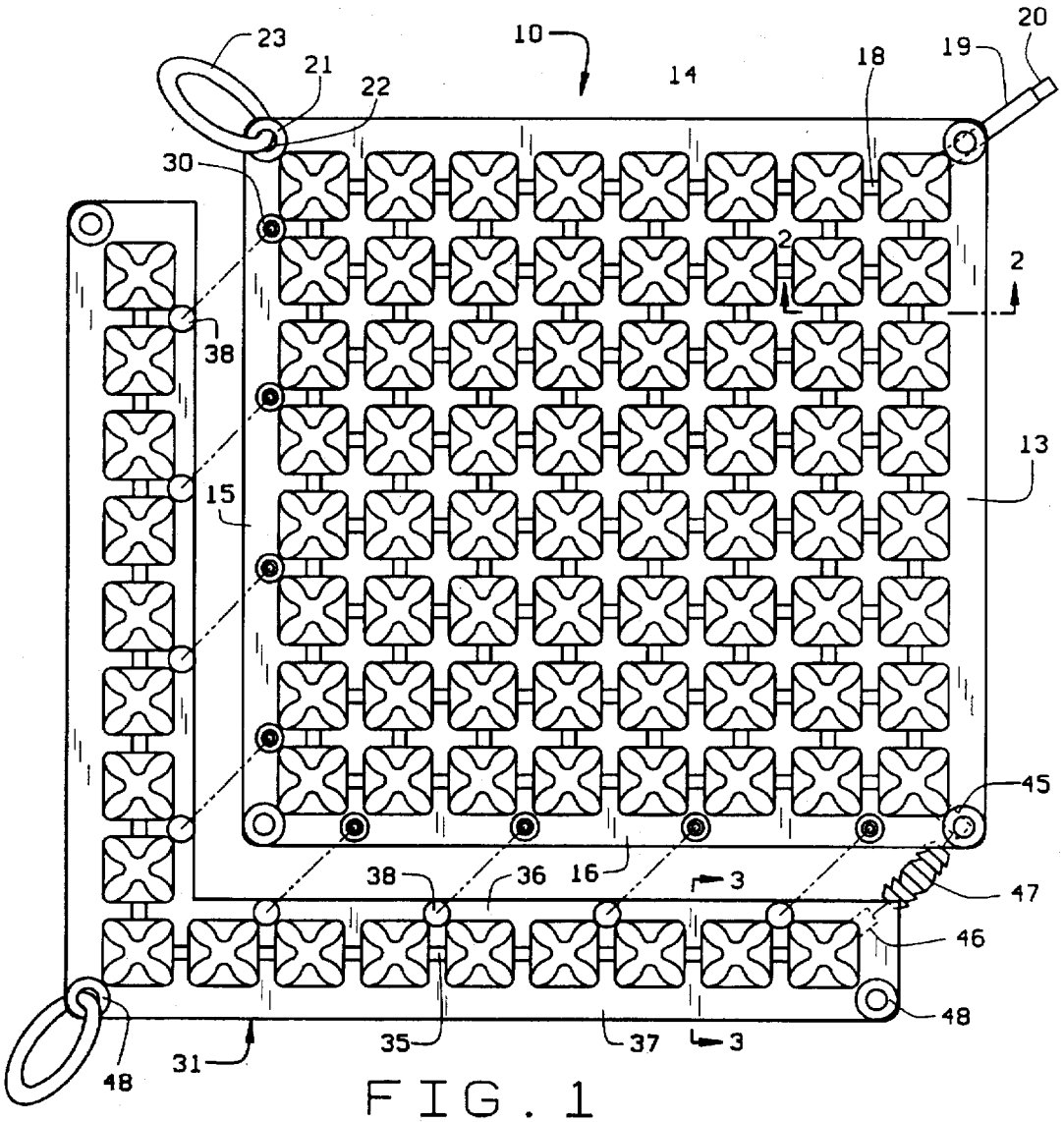
FIG. 1 is a plan view of a first embodiment of the invention.
Figure 3:
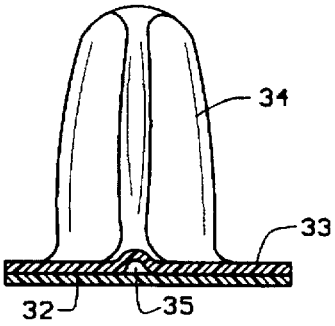
FIG. 3 is a fragmentary sectional view taken along line 3—3 of FIG. 1.
Figure 2:
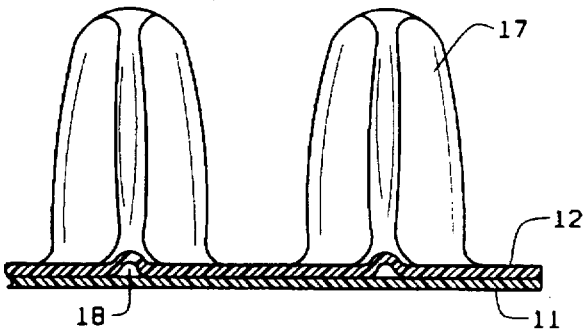
FIG. 2 is a fragmentary sectional view taken along line 2—2 of FIG. 1.

FIGS. 1–3 show a first embodiment of the invention which comprises a base cushion 10 which is of conventional ROHO construction as exemplified by Graebe U.S. Pat. Nos. 3,605,145; 3,870,450 and 4,541,136, the disclosures of which are all incorporated herein by reference as fully as if specifically set forth herein. Reference to the aforesaid patents will disclose all details of construction of each of the types of cushions disclosed in the patents. However, all base cushions 10 have a base layer 11 and a top layer 12 adhered thereto around the edge margins 13,14,15,16 and at defined areas within the body area defined by the edge margins 13,14,15,16. Integrally formed in the top layer 12 are upstanding flexible inflatable cells 17. Selected cells 17 are connected by passages 18 between the top layer 12 and the base layer 11. The location of the passages 18 is determined by the type of base cushion 10 that is used. For example, in one form of the cushion shown in Graebe U.S. Pat. No. 3,870,450, all of the cells 17 are interconnected, so there is a passage 18 between each cell 17 to connect all of the cells pneumatically. Other of the cushions shown in Graebe U.S. Pat. Nos. 4,698,864, 5,052,068, and 5,163,196 have only certain groups of cells 17 connected pneumatically. Each group of cells 17 has a fill tube 19 and fill shut-off nozzle 20 connected thereto. Positioned at one or more comers of the base cushion 10 are grommets 21 having a throughbore 22 to which a carrying cord 23 is attached.

Female snap fastening elements 30 are positioned along one or more of the side edges 13–16. If desired, VELCRO hook and loop fasteners can be used in place of the shown snap fasteners 30.

An L-shaped growth segment 31 is adapted to be connected to the base cushion 10. The L-shaped segment 31 is comprised of a base layer 32 and a top layer 33 which has integral upstanding flexible inflatable cells 34. Pneumatically connecting the cells 34 are a series of passages 35. The L-shaped segment 31 has an inner margin 36 positioned adjacent to the base cushion edges and an outer margin 37. Positioned along the inner margin 36 are a series of male snap fastener elements 38 which are aligned with the female snap fastener elements 30 on the base cushion margin and are used to physically and mechanically connect the segment 31 to the base cushion 20 to enlarge the base cushion 10.

The L-shaped segment 31 is the same shape and size as the base cushion 10 except that there is one more cell 34 in each lateral and horizontal row than are present in the lateral and horizontal rows of cells 17 in the base cushion 10. Thus, when the growth segment 31 is attached to the base cushion 10, the enlarged cushion illustrated is a 9×9 cushion rather than the 8×8 base cushion 10. By using this growth segment 31, the base cushion 10 can be enlarged to accommodate the natural growth of a pediatric patient or other user. Additional lateral and horizontal rows of cells 34 can be added to make a 10×10 cushion, etc.

Figure 4:
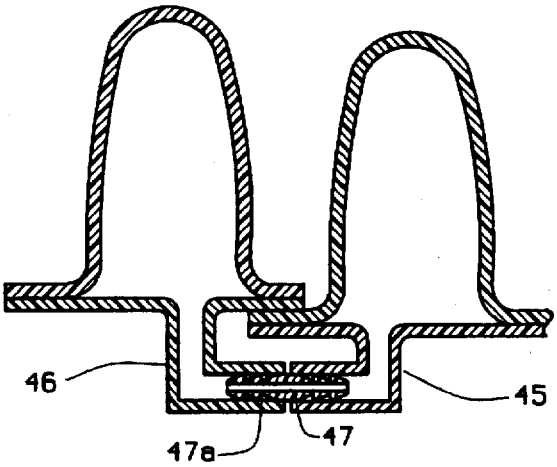
FIG. 4 is a fragmentary sectional view showing pneumatic connection of the base cushion to the growth section.

An important and critical aspect of this invention is the ability of the add-on segment 31 to be pneumatically connected to the rows of base cushion cells adjacent to the side margins to which it is physically attached. This is accomplished by a set of aligned air tubes 45 and 46 positioned on a comer of the base cushion 10 and a free end of the add-on L-shaped segment 31, respectively. When these air tubes 45 and 46 are interconnected using the connector 47 (as shown in detail in FIG. 4), the pressure in the growth cushion cells 34 is the same as the pressure in the base cushion cells 17. Thus, the entire enlarged cushion continues to function as it had before the addition of the growth segment 31. Carrying grommets 48 are positioned in the outer margins 37 at the comers of the growth segment 31. The connector 47 has a ribbed outer surface which sealingly engages the inner surfaces of the air tubes 45 and 46. The ribs **47*a* on the outer surface fictionally engage the inner surfaces of the air tubes 45 and 46** and pneumatically seal the surfaces.

Modification

Figure 5:
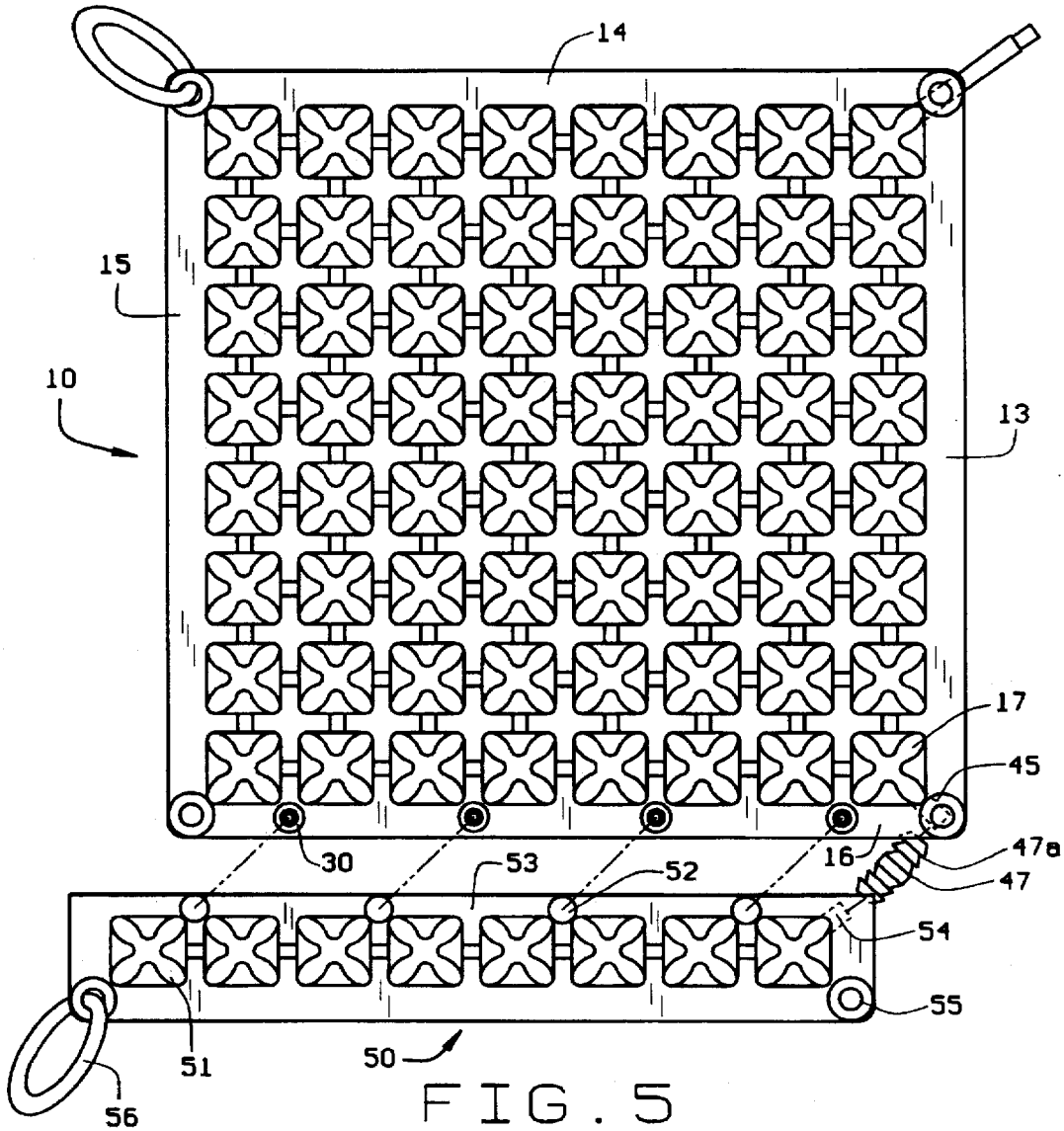
FIG. 5 is a plan view of another embodiment of the invention.

FIG. 5 shows a modification of the present invention in which the base cushion 10 is similar to that shown and described hereinbefore. However, the add-on growth segment 50 illustrated is attached only to one edge 16 of the base cushion. Positioned along the base cushion edge 16 are female snap fastener members 30. An air tube 45 is positioned and pneumatically connected to an air cell 17 at the comer of the base cushion edge 16 to which the segment 50 is connected.

The segment 50 has the same number of cells 51 as one row of the base cushion edge 16 to which it is connected by the male snap fasteners 52 in its inner margin 53. An air passage 54 is connected in the segment 50 pneumatically to the base cushion air passage 45 by a connector 47 to pneumatically connect the growth segment 50 to the base cushion 10. A grommet 55 is positioned at one of the comers of the growth segment 50 for a carrying cord 56.

While the present invention has been specifically described as being application to a pediatric cushion, it also is applicable to standard size cushions to accommodate change in size of the user, i.e., a weight gain or the like.

Second Modification

Figure 6:
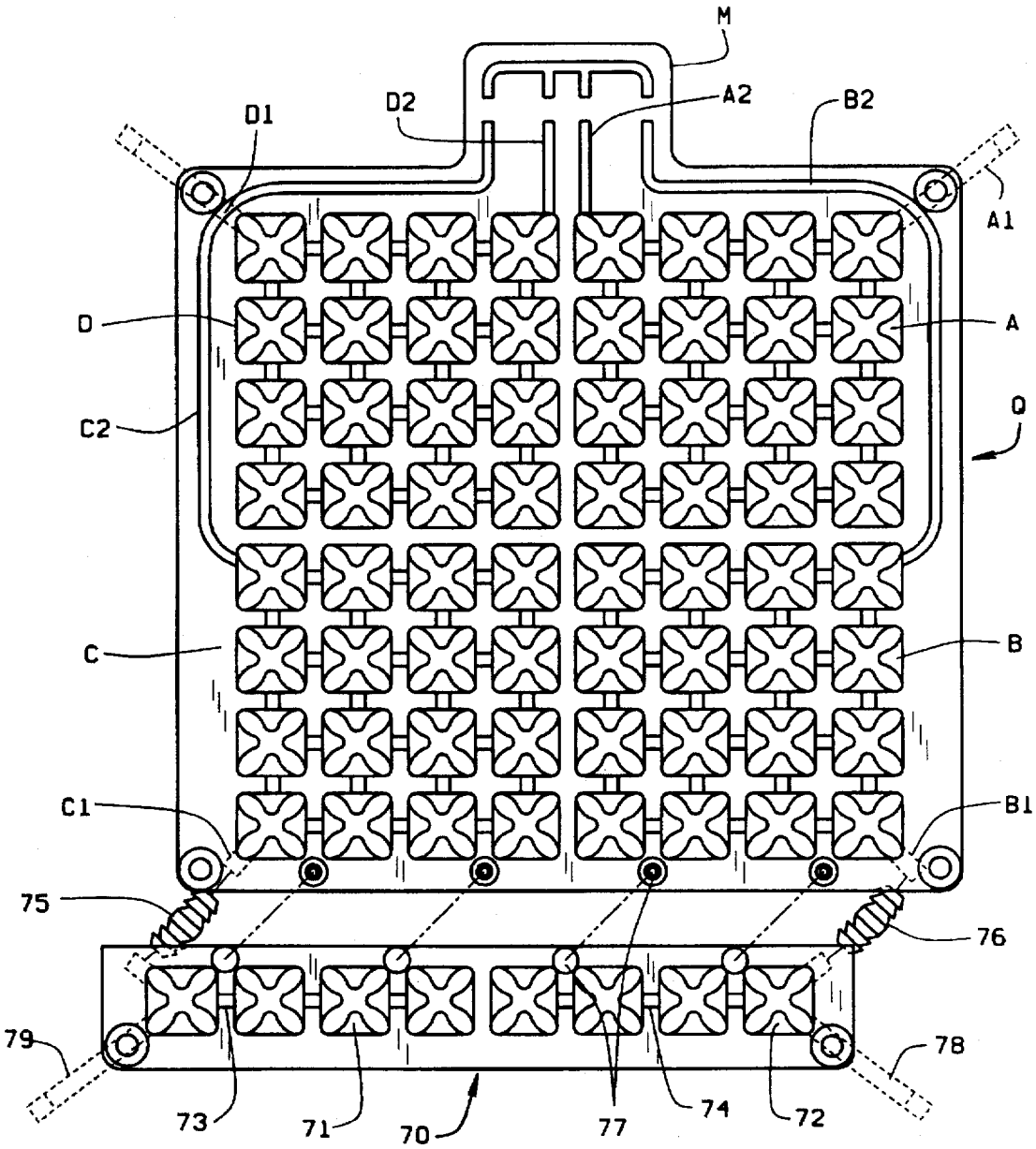
FIG. 6 is a plan view of another embodiment of the invention.

FIG. 6 shows another modification of the invention. This modification shows a variation on the Roho cushion of the type known as the QUADTRO cushion. In this type cushion Q there are four separate zones or sets of air cells, A, B, C, and D. These are each separately inflated by means of nozzles A-1, B-1, C-1, and D-1 connected to one cell in each zone or set, or can be interconnected through a manifold M. Conduits A-2, B-2, C-2, and D-2 connect the sets of cells A, B, C, and D to the manifold M. The basic cushion is shown and described in Graebe et al U.S. Pat. No. 5,163,196, and Graebe U.S. Pat. No. 5,502,855, the disclosures of which are incorporated herein by reference as if set out in detail.

FIG. 6 shows a longitudinal extension member 70 which comprises two separate zones or sets of cells 71,72. The sets 71,72 are not connected, but the cells within each set are interconnected by passages 73,74.

A connector 75 connects the set 71 to the cushion cell set C and a connector 76 connects the set 72 to the cushion cell set B. Thus, the cushion is extendible only in a longitudinal direction. The snap fasteners 77 physically connect the extension 70 to the basic cushion Q. The extension 70 can have additional rows of cells to extend the cushion Q additionally in length, if desired. When the extension 70 is connected to the cushion Q, the fill tube 78 is used to independently inflate and deflate the cell sets B and 72 and the fill tube 79 is used to independently inflate and deflate the cell sets C and 71.

Third Modification

Figure 7:
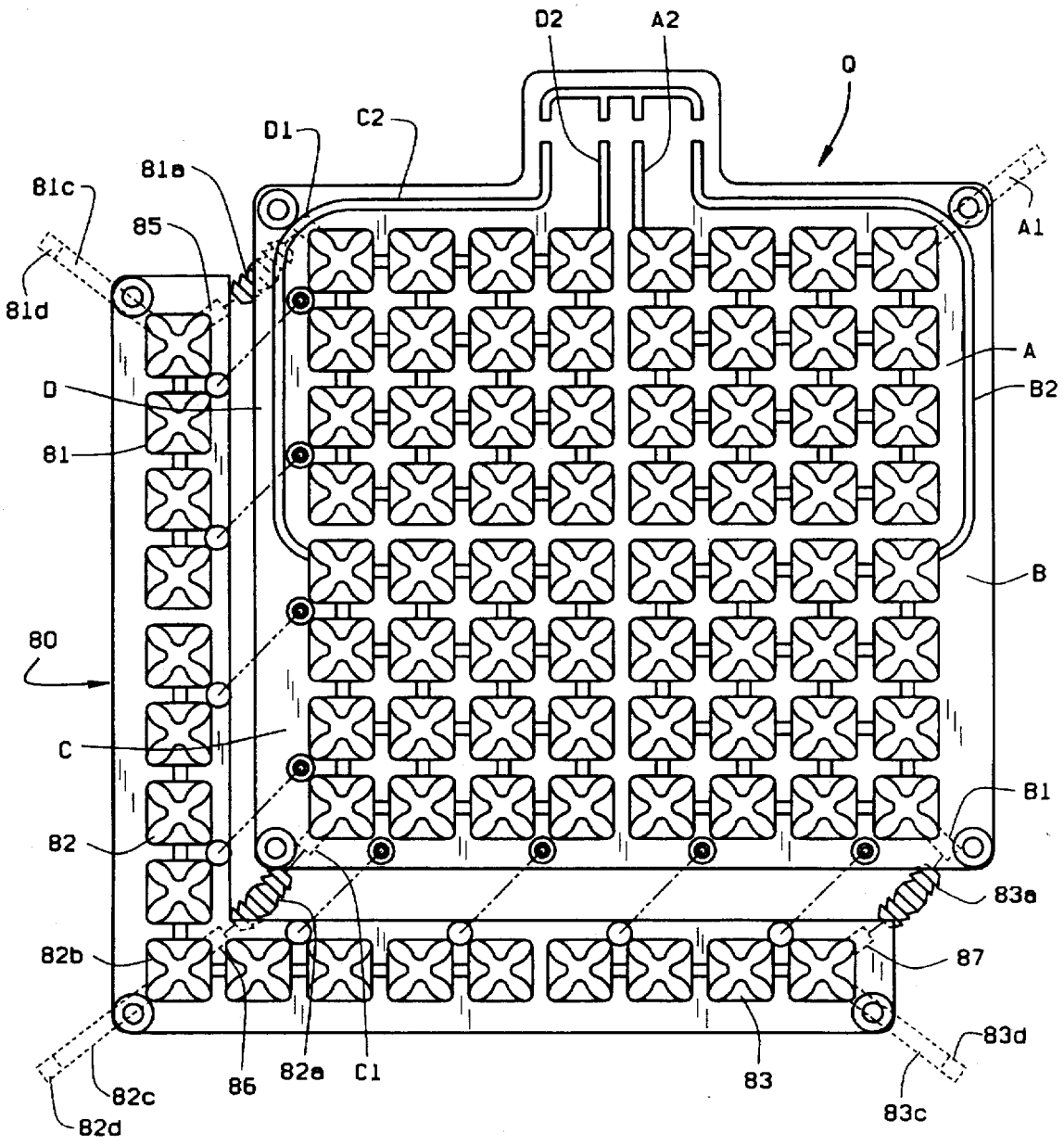
FIG. 7 is a plan view of still another embodiment of the invention.

FIG. 7 shows another modification to the QUADTRO type cushion. The base cushion Q is of the type shown in Graebe et al U.S. Pat. No. 5,163,196 and Graebe U.S. Pat. No. 5,502,855, i.e., it is similar to the cushion Q hereinbefore described and shown in FIG. 6.

The extensible cushion section 80 of FIG. 7, however, is different from the extensible cushion section 70 of FIG. 6. The cushion section 80 has three zones or sets of cells in which the cells in each zone or set are connected, but the zones or sets are separate. The sets are designated 81,82,83. The set 81 is connected pneumatically to the cushion zone section D by the connector **81*a*. The set 82 is connected to the cushion zone section C by the connector 82*a* and the set 83 is connected to the cushion zone section B by the connector 83*a*. This form of extension allows the base cushion to be extended both laterally and longitudinally although it does result in an unbalanced lateral extension. In other words, when the section 80 is connected to the base cushion, the zones C and D combined with sets 81,82 are wider than the zones A and B. Balance is maintained, however, in the longitudinal direction, as the zones B and C combined with sets 82,83** are equally long from front to rear.

As noted, the extension cushion 80 has three sets of pneumatically independent cells, 81,82,83. The sets 81 and 83 are each 4 cells in length, while the set 82 has 9 cells, 4 cells in the longitudinal direction, 4 cells in the lateral direction and a common comer cell **82*b*. Each of the sets of cells 81,82,83 also has an independent fill tube 81*c*,82*c*,83*c*, respectively. The fill tubes 81*c*,82*c*,83*c* are used to inflate and deflate the cushion cell sets D, C and B, respectively as well as the extension cell sets 81,82,83**.

Each of the fill tubes **81*c*, 82*c*, 83*c* is provided with a manually operated on-off valve 81*d*,82*d*,83*d***, respectively.

The connectors 81*a*,82*a*,83*a* pneumatically connect the normal fill tubes D-1,C-1,B-1 which are part of the base cushion Q to conduits 85,86,87 which are pneumatically connected to the cell sets 81,82,83, respectively.

This invention is intended to cover all changes and modifications of the examples of the invention herein chosen for purposes of the disclosure which do not constitute departures from the spirit and scope of the invention.

What is claimed is:

1. In a base cushion which comprises a base section and a top section bonded thereto, the top section having an array of upstanding inflatable flexible air cells, some of which are interconnected so that those interconnected air cells are at the same air pressure, and an independent fill nozzle for said air cells, the improvement comprising an add-on segment comprising a base section and a top section bonded thereto, the top section having upstanding flexible inflatable air cells, means for physically attaching the add-on segment to the base cushion along one or more peripheral edges, a conduit on the exterior of the base cushion pneumatically connected to the array of air cells, a second conduit on the exterior of the add-on segment and alignable with the base cushion conduit, and a connector positioned between and pneumatically connected to the said conduits on the exteriors of the air cells to pneumatically connect the base cushion air cell array to the add-on air cells.

2. The cushion of claim 1 wherein at least some of the air cells in the add-on segment are pneumatically interconnected.

3. The cushion of claim 1 wherein the add-on segment has the same number of air cells as the base cushion edge to which it is attached.

4. The cushion of claim 1 wherein the add-on segment is substantially L-shaped and the number of air cells in each leg of the segment is one greater than the number of cells on the edge of the base cushion adjacent to the segment legs.

5. The cushion of claim 1 being a wheelchair cushion.

6. The cushion of claim 1 being a wheelchair cushion adapted for pediatric use.

7. The cushion of claim 1 wherein the connector has an outer ribbed body, the connector being insertable into the air conduits in an air tight seal.

8. The cushion of claim 7 including a fill nozzle with an on-off valve attached to a cell of the add-on segment.

9. In a cellular base cushion comprising: a flexible non-rigid base; an array of flexible and hollow inflatable air cells attached to and projecting away from the base, the cells being organized into zones, with the interiors of the cells for each zone within the region of the zone being in communication through the base, but not with the air cells of the other zones; independent means for introducing air into the cells of each of the zones; the improvement comprising an add-on segment comprising a base section and a top section bonded thereto, the top section having upstanding flexible inflatable air cells, means for physically attaching the add-on segment to the base cushion along one or more peripheral edges, a conduit on the exterior of the base cushion pneumatically connected to the array of air cells, a second conduit on the exterior of the add-on segment and alignable with the base cushion conduit, and a connector positioned between and pneumatically connected to the said conduits on the exteriors of the air cells to pneumatically connect the base cushion air cell array to the add-on air cells.

10. The cushion of claim 9 wherein at least some of the air cells in the add-on segment are pneumatically interconnected.

11. The cushion of claim 9 wherein the add-on segment has the same number of air cells as the base cushion edge to which it is attached.

12. The cushion of claim 9 wherein the add-on segment is substantially L-shaped and the number of air cells in each leg of the segment is one greater than the number of cells on the edge of the base cushion adjacent to the segment legs.

13. The cushion of claim 9 being a wheelchair cushion.

14. The cushion of claim 9 being a wheelchair cushion adapted for pediatric use.

15. The cushion of claim 9 wherein the cellular cushion is divided into four independent zones of rectangular configuration and wherein the cells in the add-on cushion are interconnected so as to form sets of interconnected cells which are contiguous to corresponding zones of cells in the cellular cushion and each set is connected pneumatically only to the contiguous zone.

16. A cellular base cushion comprising a flexible non-rigid base throughout the cellular area of the cushion, said flexible base having front, rear and side edges, an array of flexible and hollow air containing cells attached to and projecting away from the flexible base, the cells being organized into zones, with the interiors of the cells for each zone within the region of the zone being in communication through the flexible base, but not with the air cells of the other zones, a manifold located at one edge of the flexible base and extending outwardly from the flexible base, first and second separate and independent air passages connected to each zone, said first air passage for each zone defining a fixed channel extending between at least one cell of its zone and the manifold, the channels being connected to the cushion cells through the flexible base of the cushion and the channels extending along the underside of the flexible base to the manifold, whereby the cells of the different zones communicate only through the manifold, and means for selectively blocking the channels independently of the manifold so that the cells of the different zones do not communicate and the air pressure of each zone can be adjusted independently, said second air passage for each zone being separate form and independent of the first air passage and the manifold to allow adding and bleeding air only from the zone to which it is connected, an add-on segment comprising a base section and a top section bonded thereto, the top section having upstanding flexible inflatable air cells, said segment being physically attachable to the base cushion along one or more peripheral edges, a conduit on the exterior of the base cushion pneumatically connected to the array of air cells, a second conduit on the exterior of the add-on segment and alignable with the base cushion conduit, and a connector positioned between and pneumatically connected to the said conduits on the exteriors of the air cells to pneumatically connect the base cushion air cell array to the add-on air cells.

17. The cushion of claim 16 wherein at least some of the air cells in the add-on segment are pneumatically interconnected.

18. The cushion of claim 16 wherein the add-on segment is substantially L-shaped and the number of air cells in each leg of the segment is one greater than the number of cells on the edge of the base cushion adjacent to the segment legs.

19. The cushion of claim 16 wherein the cellular cushion is divided into four independent zones of rectangular configuration and wherein the cells in the add-on cushion are interconnected so as to form sets of interconnected cells which are contiguous to corresponding zones of cells in the cellular cushion and each set is connected pneumatically only to the contiguous zone.

20. The cushion of claim 19 wherein the add-on segment is L-shaped and is divided into 3 pneumatically separate zones which are pneumatically attachable to the adjacent base cushion zone.

21. In a base cushion which comprises a base section and a top section bonded thereto, the top section having upstanding inflatable flexible air cells, some of which are interconnected so that those interconnected air cells are at the same air pressure, the improvement comprising an add-on segment comprising a base section and a top section bonded thereto, the top section having upstanding flexible inflatable air cells, said segment being physically attachable to the base cushion along one or more peripheral edges and pneumatically attachable to the base cushion air cells positioned adjacent said peripheral edges, said add-on segment being substantially L-shaped and the number of air cells in each leg of the segment being one greater than the number of cells on the edge of the base cushion adjacent to the segment legs.

22. In a cellular base cushion comprising: a flexible non-rigid base; a plurality of flexible and hollow inflatable air cells attached to and projecting away from the base, the cells being organized into zones, with the interiors of the cells for each zone within the region of the zone being in communication through the base, but not with the air cells of the other zones; independent means for introducing air into the cells of each of the zones; the improvement comprising a substantially L-shaped add-on segment comprising a base section and a top section bonded thereto, the top section having upstanding flexible inflatable air cells, said segment being physically attachable to the base cushion along one or more peripheral edges and pneumatically attachable to the base cushion air cell zone positioned adjacent said peripheral edges, the number of air cells in each leg of the add-on segment being one greater than the number of cells on the edge of the base cushion adjacent to the segment legs.

23. A cellular base cushion comprising a flexible non-rigid base throughout the cellular area of the cushion, said flexible base having front, rear and side edges, a plurality of flexible and hollow air containing cells attached to and projecting away from the flexible base, the cells being organized into zones, with the interiors of the cells for each zone within the region of the zone being in communication through the flexible base, but not with the air cells of the other zones, a manifold located at one edge of the flexible base and extending outwardly from the flexible base, first and second separate and independent air passages connected to each zone, said first air passage for each zone defining a fixed channel extending between at least one cell of its zone and the manifold, the channels being connected to the cushion cells through the flexible base of the cushion and the channels extending along the underside of the flexible base to the manifold, whereby the cells of the different zones communicate only through the manifold, and means for selectively blocking the channels independently of the manifold so that the cells of the different zones do not communicate and the air pressure of each zone can be adjusted independently, said second air passage for each zone being separate from and independent of the first air passage and the manifold to allow adding and bleeding air only from the zone to which it is connected, the improvement comprising a substantially L-shaped add-on segment comprising a base section and a top section bonded thereto, the top section having upstanding flexible inflatable air cells, said segment being physically attachable to the base cushion along one or more peripheral edges; and pneumatically attachable to the base cushion air cell zone positioned adjacent said peripheral edges, the number of air cells in each leg of the segment being one greater than the number of cells on the edge of the base cushion adjacent to the segment legs.

24. A cellular base cushion comprising a flexible non-rigid base throughout the cellular area of the cushion, said flexible base having front, rear and side edges, a plurality of flexible and hollow air containing cells attached to and projecting away from the flexible base, the cells being organized into four zones of rectangular configuration, with the interiors of the cells for each zone within the region of the zone being in communication through the flexible base, but not with the air cells of the other zones, a manifold located at one edge of the flexible base and extending outwardly from the flexible base, first and second separate and independent air passages connected to each zone, said first air passage for each zone defining a fixed channel extending between at least one cell of its zone and the manifold, the channels being connected to the cushion cells through the flexible base of the cushion and the channels extending along the underside of the flexible base to the manifold, whereby the cells of the different zones communicate only through the manifold, and means for selectively blocking the channels independently of the manifold so that the cells of the different zones do not communicate and the air pressure of each zone can be adjusted independently, said second air passage for each zone being separate from and independent of the first air passage and the manifold to allow adding and bleeding air only from the zone to which it is connected, the improvement comprising a substantially L-shaped add-on segment comprising a base section and a top section bonded thereto, the top section having upstanding flexible inflatable air cells, said segment being physically attachable to the base cushion alone one or more peripheral edges, and pneumatically attachable to the base cushion air cell zone positioned adjacent said peripheral edges, the cells in the L-shaped add-on cushion being interconnected so as to form sets of interconnected cells which are contiguous to corresponding zones of cells in the cellular cushion and each set is connected pneumatically only to the contiguous zone.

25. The cushion of claim 24 wherein the add-on segment is divided into three pneumatically separate zones which are pneumatically attachable only to the adjacent base cushion zone.

* * * * *